US005318387A

United States Patent [19]

Pienaar et al.

[11] Patent Number: 5,318,387

[45] Date of Patent: Jun. 7, 1994

[54] YIELDABLE LOAD SUPPORT

[75] Inventors: Frans R. P. Pienaar, Krugersdorp; Graham H. Clarke, Boksburg; Brian P. Lewis, Meredale; Mark Howell, Westonaria Extension; Richard G. King, Midrand; Peter J. Cook, Johannesburg, all of South Africa

[73] Assignee: H L & H Timber Products (Proprietary) Limited, Johannesburg, South Africa

[21] Appl. No.: 850,927

[22] Filed: Mar. 13, 1992

[30] Foreign Application Priority Data

Mar. 13, 1991 [ZA] South Africa ..... 91/1835
May 29, 1991 [ZA] South Africa ..... 91/4082

[51] Int. Cl.[5] ..... E21D 11/05

[52] U.S. Cl. ..... 405/288; 405/272; 405/303; 248/544

[58] Field of Search ..... 405/297, 288, 272, 303, 405/290; 248/357, 351, 544

[56] References Cited

U.S. PATENT DOCUMENTS

| | | | |
|---|---|---|---|
| 459,857 | 9/1891 | Olcott | 405/288 X |
| 692,111 | 1/1902 | Brunton | 405/288 X |
| 759,418 | 5/1904 | Brunton | 405/288 X |
| 875,182 | 12/1907 | Keighley | 405/288 |
| 1,528,034 | 3/1925 | Thielmann | 405/288 |
| 1,946,720 | 2/1934 | Stearns | 405/288 |
| 2,190,556 | 2/1940 | Wiebecke et al. | 405/288 |
| 2,301,489 | 11/1942 | Wiebecke | 405/288 |
| 4,497,597 | 2/1985 | Chlumecky | 405/288 |
| 4,534,531 | 8/1985 | Brown | 248/357 X |
| 4,915,339 | 4/1990 | Halbich | 248/357 X |
| 5,186,430 | 2/1993 | Ellithorpe | 405/288 X |

FOREIGN PATENT DOCUMENTS

80/6671 10/1980 South Africa .

*Primary Examiner*—Randolph A. Reese
*Assistant Examiner*—J. Russell McBee

[57] ABSTRACT

The yieldable load support comprises a compressible support member in the form of an elongate timber pole. The load support or pole is asymmetrically modified at or near one end thereof in a manner to positively induce sideways brushing of the pole at the modified end, in a preferential direction transverse to the length of the pole, when the support member is placed under longitudinal compressive load of sufficient magnitude.

22 Claims, 4 Drawing Sheets

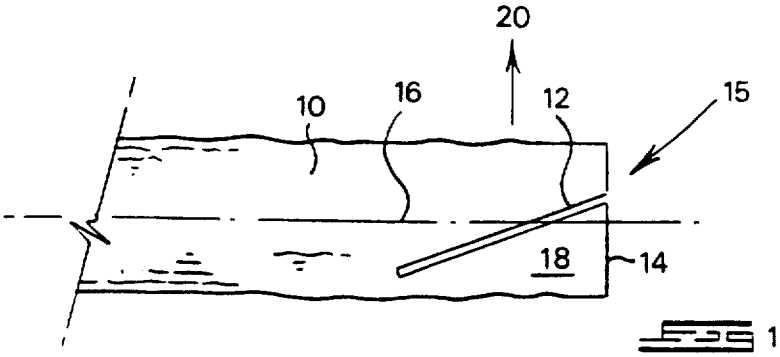
FIG 1
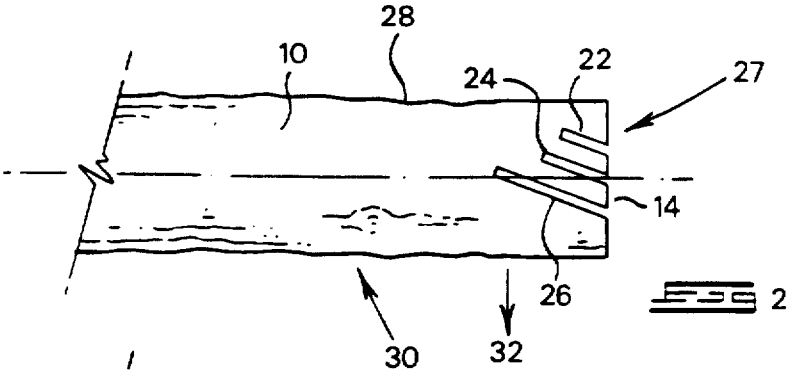
FIG 2
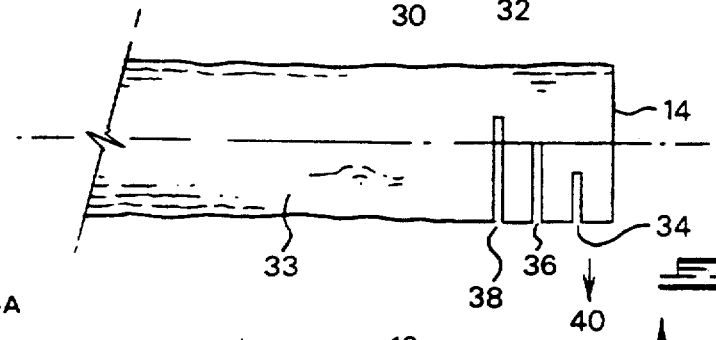
FIG 3
FIG 4A
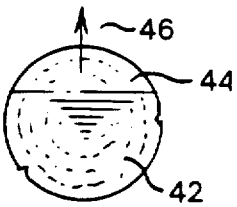
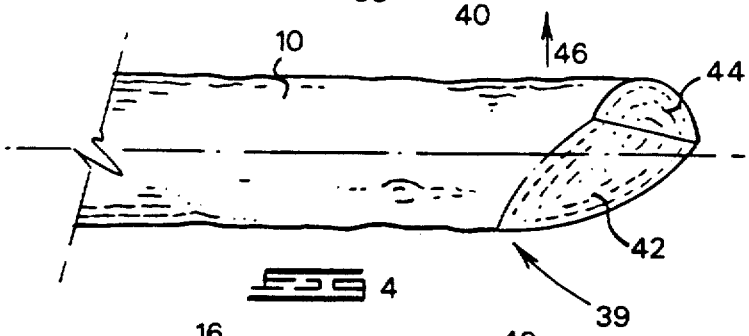
FIG 4
FIG 5A
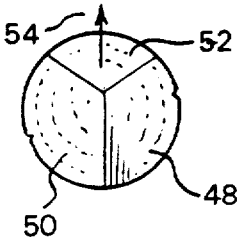
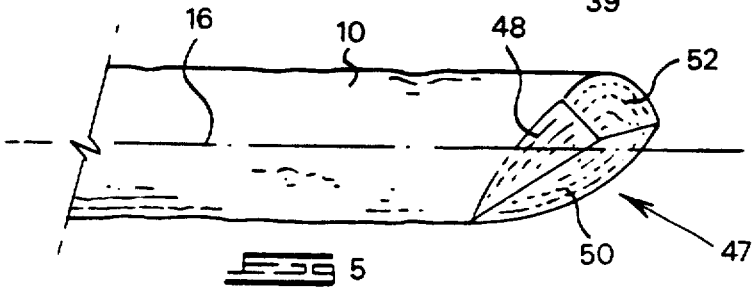
FIG 5

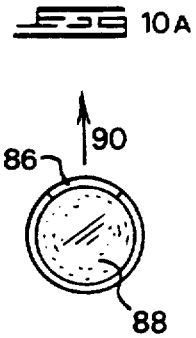
10A
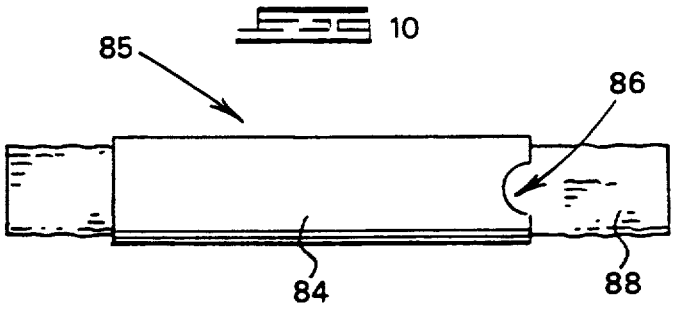
10
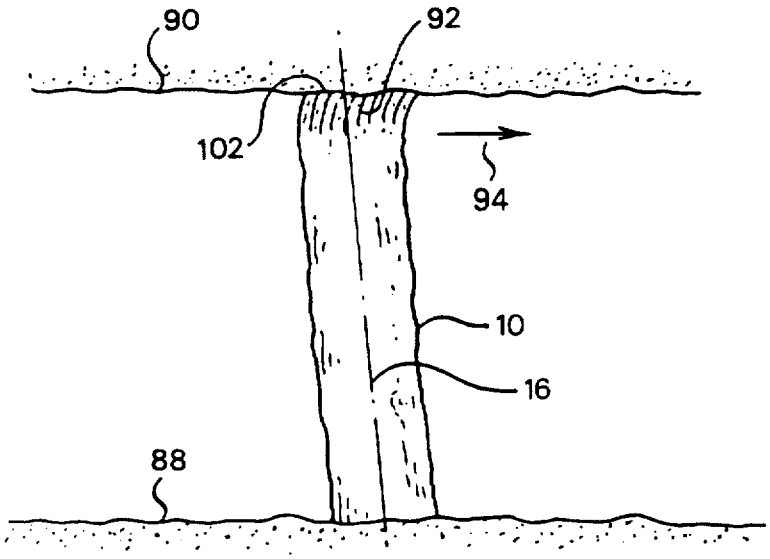
11
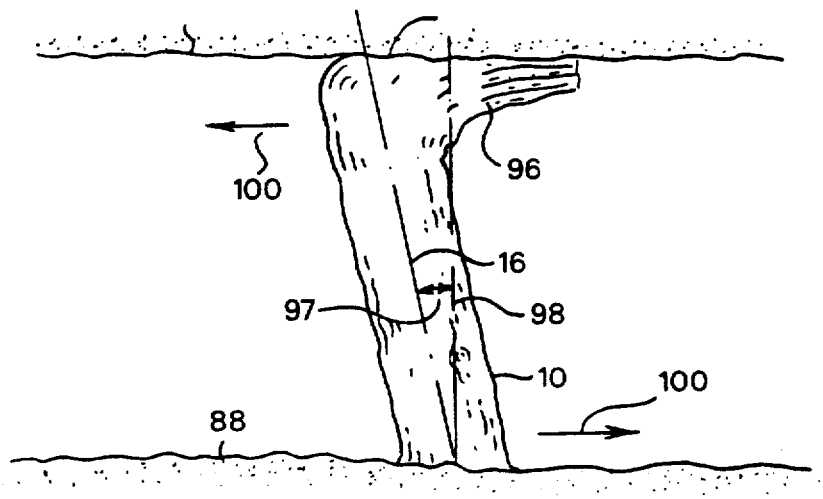
12

Fig 13
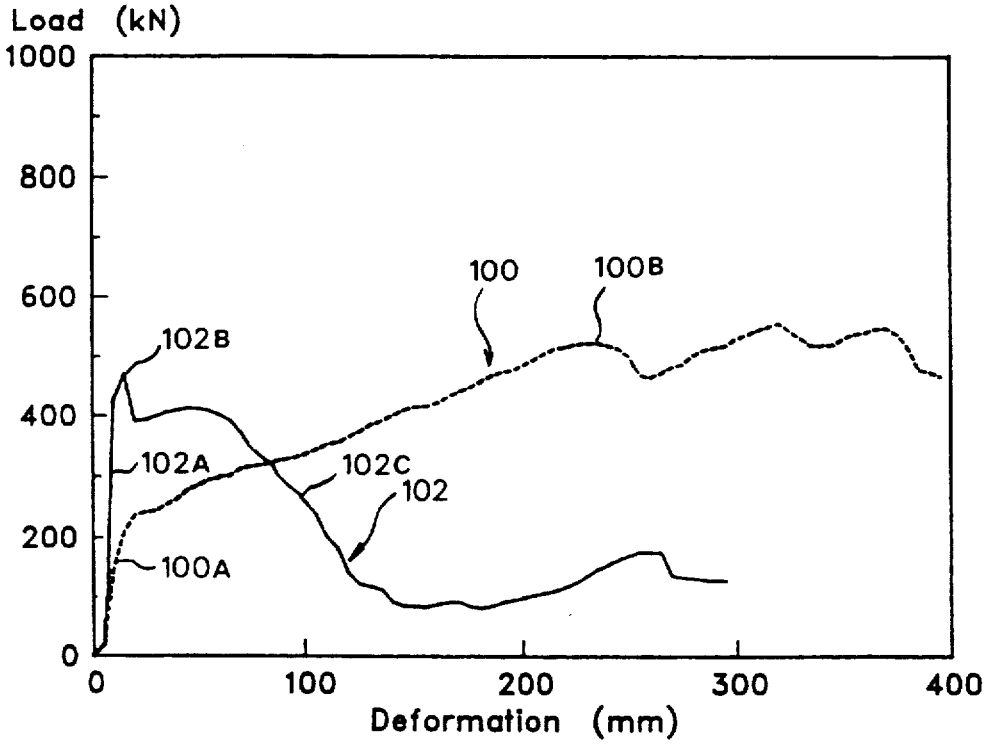
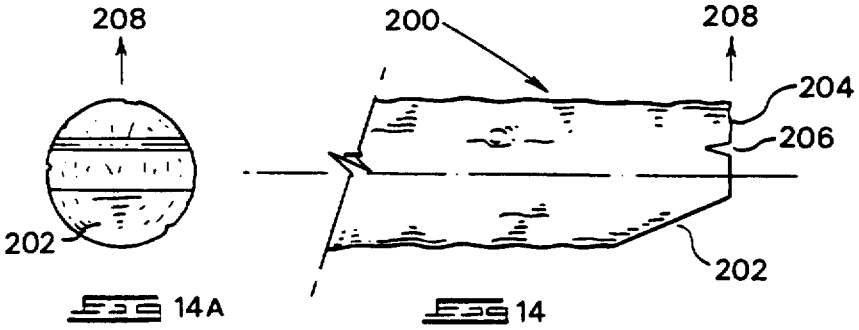
Fig 14A Fig 14

YIELDABLE LOAD SUPPORT

BACKGROUND TO THE INVENTION

This invention relates to a yieldable load support in the form of an elongate timber prop, which is designed to yield under high compressive loads. Such supports are generally, but not necessarily exclusively, utilised as props in underground mines.

Numerous different types of timber props have been proposed and manufactured. Ideally, a timber prop should be able to accept compressive load rapidly and thereafter to yield while still taking the compressive load. A typical example of a timber prop which has been used widely in the past with a certain degree of success is the PROFILE PROP, which is the subject of South African Patent 80/6671.

SUMMARY OF THE INVENTION

One aspect of the invention provides a yieldable load support comprising a compressible support member in the form of an elongate timber pole, the load support being asymmetrically modified at or near at least one end thereof in a manner to positively induce sideways brushing of the pole at the modified end, in a preferential direction transverse to the length of the pole, when the support member is placed under longitudinal compressive load of sufficient magnitude.

Another aspect of the invention provides a yieldable load support comprising a compressible support member in the form of an elongate timber pole, the pole being asymmetrically modified at or near at least one end thereof in a manner to positively induce sideways brushing of the pole at the modified end, in a preferential direction transverse to the length of the pole, when the support member is place under longitudinal compressive load of sufficient magnitude.

Material may be removed asymmetrically from at least one end of the timber pole to induce sideways brushing of the pole at the relevant end.

In some embodiments, at least one slot is cut asymmetrically in the timber pole at or adjacent the at least one end thereof. The slot is typically inclined at an acute angle to the axis of the timber pole. There can be a plurality of slots of varying depth and all inclined at an acute angle to the axis of the timber pole. Alternatively, there can be a plurality of slots cut into the side of the timber pole adjacent the at least one end thereof, the slots being of varying depth and all normal to the axis of the timber pole.

In other embodiments, at least one angled cut is made in the at least one end of the timber pole to provide the end of the pole with an asymmetrical angled face that is inclined at an acute angle to the axis of the pole. There may be two or more angled cuts made in the at least one end of the pole to provide the end of the pole with a plurality of asymmetrical angles faces each inclined at an acute angle to the axis of the pole. In some cases, the two or more angles cuts are made in such a manner as to leave a residual flat surface at the end of the pole, and the residual flat surface may be off-set from, or on, the axis of the timber pole. In other cases a single angled cut is made in the at least one end of the timber pole to provide the end of the pole with an asymmetrical angled face that is inclined at an acute angle to the axis of the pole and a slot, typically wedge-shaped, is cut in the end of the pole at a position off-set from the axis of the pole.

In still other embodiments, material is removed from the at least one end of the timber pole to provide that end of the pole with a conical shape which is asymmetrical with respect to the axis of the pole. This can be done in such a manner that a residual flat surface is left at the apex of the conical shape, such residual flat surface being off-set from the axis of the pole. In addition, there can be a transverse shoulder around the base of the conical shape.

In yet another embodiment, the load support comprises a timber pole encased in a steel sleeve, an end of the load support being modified by asymmetrical removal of material from the relevant end of the sleeve.

In a further embodiment, an end of the load support is modified by strengthening means applied to the load support at the relevant end.

Preferably, each of the yieldable load supports summarised above is adapted for use as a yieldable mine prop to support a hanging wall above a footwall in a working mine.

Another aspect of the invention provides a method of making a yieldable mine prop, the method comprising the steps of providing an elongated timber pole and modifying the timber pole, at or near at least one end thereof, in a manner to positively induce sideways brushing of the pole at the modified end, in a preferential direction transverse to the length of the pole, when the pole is placed under longitudinal compressive load of sufficient magnitude.

A further aspect of the invention provides a method of supporting a mine hanging wall above a mine footwall, the method comprising the steps of installing, between the hanging and footwalls, a yieldable load support and, as the load support is compressed by closure of the hanging wall towards the footwall, allowing the timber pole at the at least one modified end to brush over in the preferential direction and also allowing the timber pole to assume an inclined orientation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 1 to 3 show various embodiments of the upper portions of mine props according to the invention in which various saw cut arrangements are applied to provide weakened zones;

FIGS. 4 to 7 and 14 show further embodiments of the upper portions of mine props of the invention in which a residual flat portion which constitutes the uppermost face of the mine prop is formed by removing one or more wedges of timber from the operatively upper end of the mine prop;

FIGS. 4A to 7A and 14A show respective top plan views of the mine props of FIGS. 4 to 7 and 14;

FIG. 10 shows yet a further embodiment of an upper portion of a mine prop of the invention;

FIG. 10A shows an end view of the prop seen in FIG. 10;

FIGS. 11 and 12 show primary and secondary stages in the deformation of any one of the mine props illustrated in FIGS. 1 to 9; and FIG. 13 is a graph illustrating the performance of the embodiment of FIG. 6.

DESCRIPTION OF EMBODIMENTS

Figure 6A:
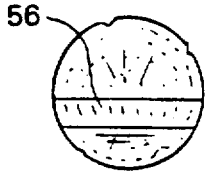

Referring to FIG. 1, an elongate timber pole 10 has a single angled saw cut 12 extending inwardly from its operatively upper end 14 to form a mine prop 15. It can clearly be seen that the saw cut 12 is slanted with respect to the central load axis 16 of the timber prop 10. When the prop is placed under compression, it can be expected that the substantially wedge-shaped portion 18 defined by the cut 12 will initially shear off.

Subsequently, the prop will deform asymmetrically, i.e. brush over, in the sideways direction indicated by the arrow 20.

Referring now to FIG. 2, three spaced saw cuts 22, 24 and 26, of progressively increasing depth, are formed in the operatively upper end 14 of the timber pole 10 to form a mine prop 27. The angled saw cuts will tend to cause the side 28 nearest to the saw cut 22 to deform under compression more rapidly than the side 30 of the prop. Asymmetrical deformation, i.e. brushing, will occur in the direction of the arrow 32.

Referring now to FIG. 3, a further embodiment of mine prop 33 is shown in which three axially spaced cuts 34, 36 and 38 are made towards the upper end of the timber pole 10. It will be noted that the cuts lie in planes transverse to the central load axis of the pole 10. The cuts increase progressively in depth from the operatively upper end 14 of the prop 33. In use, with the prop under compressive load, the pattern of cuts 34, 36 and 38 will cause asymmetrical deformation of the prop, i.e. brushing, in the direction of the arrow 40.

Referring now to FIG. 4, a further embodiment of mine prop 39 of the invention is shown in which a wedge-shaped portion of the operatively upper end of the pole 10 is removed by means of a single angled saw cut. This results in the formation of an angled face 42 and a residual flat portion 44 which represents the remainder of the end face of the prop. Under axial compression, the prop will deform asymmetrically, i.e. brush over, in the direction of the arrow 46.

In FIG. 5, two adjacent wedge-shaped portions are cut from the operatively upper end of the pole 10 by means of appropriate saw cuts so as to provide a prop 47 having two angled faces 48 and 50 and a residual flat portion 52. Asymmetrical deformation, i.e. brushing over, of the prop 47 will occur in the direction of arrow 54 under compressive loading.

Figure 6:
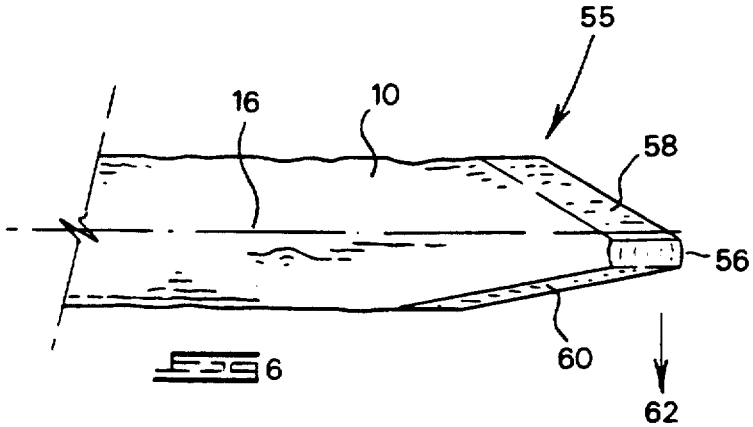

Referring now to FIG. 6, a further embodiment is shown in which wedge-shaped portions are removed from opposite sides of the pole 10 by means of angled saw cuts. The resultant prop 55 has a substantially rectangular-shaped residual portion 56 which is slightly off-set in relation to the central load axis 16.

The residual portion 56 in FIG. 6 is flanked by opposed angled faces 58 and 60. In the illustrated case, the angled face 60 makes a more acute angle with the load axis 16 than does the angled face 58. In other cases the faces may be at equal inclinations to the central load axis. In such cases, it will be appreciated that the residual portion 56 will, of necessity, be off-set from the central load axis if the resulting structure is to have the desired tendency to brush over in one direction or the other.

In other versions similar to FIG. 6, the residual portion 56 may lie on the central axis 16. In these versions, the faces 58 and 60 will generally be at different inclinations to the central load axis to promote the desired asymmetrical deformation or brushing over of the prop under compressive load.

It will be understood that the prop seen in FIG. 6 will deform asymmetrically, i.e. brush over, in the direction of the arrow 62 when under compressive loading of sufficient magnitude.

Figure 7A:
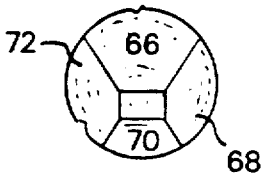
Figure 7:
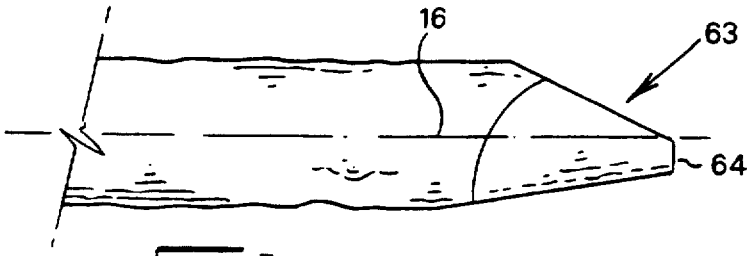

In FIG. 7, a further embodiment is illustrated in which four angled saw cuts are made in the operatively upper end of the timber post 10 so as to provide a mine prop 63 having a residual rectangular portion 64 at the upper end thereof which is offset from the load axis 16. The four opposite angled saw cuts defined four angled faces 66, 68, 70 and 72.

As explained with reference to FIG. 6, the faces 66, 68, 70 and 72 may all be at the same, or at different, inclinations to the central load axis, the important feature nevertheless being the promotion of asymmetrical deformation, i.e. brushing, of the prop under compressive loading of sufficient magnitude.

FIG. 14 shows another embodiment of mine prop 200 in which a single saw cut is made in the end of the prop to form an angled face 202 and a residual upper surface 204. A shallow wedge shaped slot 206 is formed in the residual upper surface 204, off-set from the load axis of the prop. Under sufficient compressive load, the upper end of the prop 200 will brush over in the direction 208.

Figure 8A:
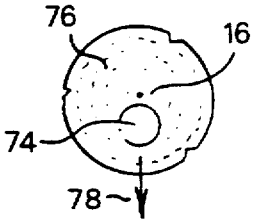
FIG. 8A shows a top plan view of the mine prop of FIG. 8.
Figure 8:
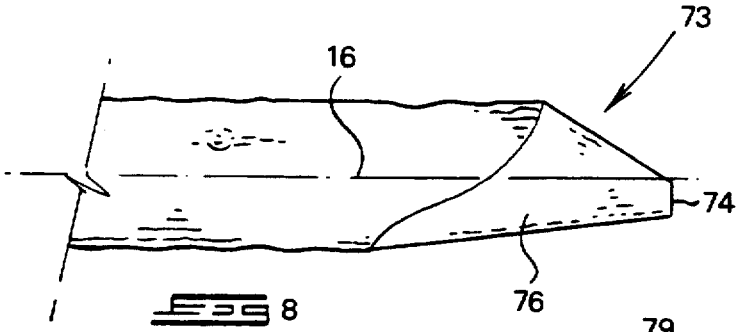
FIG. 8 shows a further embodiment of an upper portion of a mine prop of the invention in which a frustum is cut from the operatively upper end of the mine prop.

In FIG. 8, a further embodiment of mine prop 73 is shown in which a frustum cut is made in the operatively upper end of the timber post so as to form a residual circular face 74 which is offset from the load axis 16 of the prop, the circular face 74 being flanked by a frustoconically inclined surface 76. In this case, asymmetrical deformation or brushing over of the prop will occur in the direction of arrow 78 when the prop is under compressive loading of sufficient magnitude.

Figure 9A:
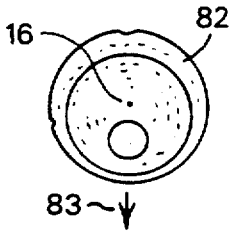
FIG. 9A shows a top plan view of the mine prop of FIG. 9.
Figure 9:
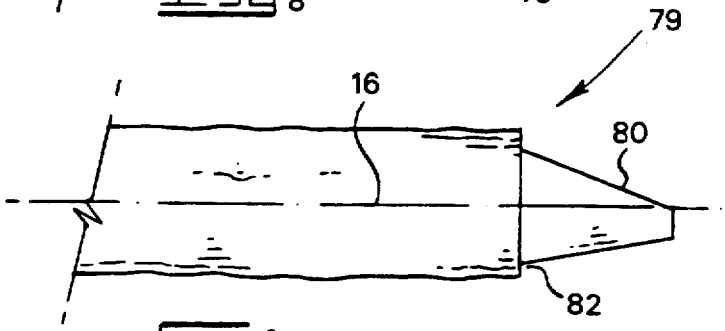
FIG. 9 shows a side view of a further embodiment of an upper portion of the mine prop of the invention.

FIG. 9 shows a further embodiment 79 which is a variation on the PROFILE PROP. An offset frustocone 80 is formed at the end of the prop. The frustocone 80 is offset from the central axis 16 of the prop and its base is flanked by a shoulder 82. Under compressive loading of sufficient magnitude the prop brushes over in the direction of the arrow 83.

Referring now to FIG. 10, a variation of the PIPESTICK PROP is shown in which the sleeve 84 of the prop 85 has a recess 86 cut into its operatively upper edge. Axial loading of this prop will cause the exposed timber end 88 of the prop to brush in the direction of arrow 90 through the unreinforced portion exposed by the recess 86.

In FIG. 11, a mine prop of the invention is shown under axial compression between respective foot and hanging walls 88 and 90 in a stope. The mine prop can be any of the props illustrated in FIGS. 1 to 9. In FIG. 11, it can clearly be seen how the operatively upper end of the prop undergoes initial brushing 92 in the direction of the arrow 94. At the same time, the central axis 16 of the prop begins to deviate from the vertical.

As can further be seen in FIG. 12, which shows an advanced stage in the deformation of the prop, extensive brushing 96 has occurred and the prop axis has deviated substantially from the vertical, as can be seen by the angle 97 between the central axis 16 of the prop and a vertical line 98 substantially normal to the foot wall 88 and the hanging wall 90. The angle 97 may be up to 30° in practice.

Although the prop may appear to be close to dislodging sideways in the direction of the arrow 100, the increased friction between the hanging wall 90 and the upper "brushed" surface 102 of the prop ensures that the prop remains wedged firmly in position. It is apparent, on comparing FIGS. 11 and 12, that the upper surface area 102 increases as the prop moves away from the vertical and is compressed, thereby resulting in an increase in the total frictional force opposing dislodgement.

In each of the described embodiments, with the exception of that of FIG. 10, it is possible if desired to provide steel bands surrounding the timber pole in regions adjacent the operatively lower end and adjacent the operatively upper end, from which material has been removed. Typically, the steel bands are of thin gauge steel strapping applied under tension to the circumference of the timber to restrain the timber from sideways deformation.

In all cases, the preferred timber for the prop is of the Saligna variety, with the grain of the timber extending in the longitudinal direction.

It has been found experimentally that a prop of the kind described with reference to FIG. 6 has admirable yield and load bearing characteristics. FIG. 13 shows a graph in which compressive load is plotted on the vertical axis against deformation, i.e. shortening of the prop under load, on the horizontal axis. The line 100 is representative of the deformation undergone by the prop 55 and is plotted as the average of a series of tests performed in a laboratory press. It will be noted that in the region 100A, the prop accepts compressive load rapidly with little deformation, and that in the subsequent region 100B, the prop continues to carry substantial compressive load as it yields. In fact, it will be observed that as the prop deforms further and further it is able to take a greater and greater compressive load. This is in fact quite logical since a greater and greater cross-sectional area of the prop performs a load bearing function as the prop shortens in vertical length.

By way of comparison in FIG. 13, a plot 102 has also been prepared for a so-called "pencil prop", i.e. a prop comprising a timber pole of corresponding diameter which has been sharpened symmetrically at one end in the manner of a pencil. In other words, no steps are taken to promote the desired asymmetrical deformation exhibited by the prop 55. In this case, it will be observed that the prop accepts load rapidly in the region 102A, with a load peak at the point 102B, and thereafter sheds load rapidly in the region 102C. At substantial deformation, the prop is able to carry very little and therefore serves a limited propping function only.

It is believed that the vastly superior performance of the prop 55 is due to the fact that steps are taken during manufacture thereof positively to promote asymmetrical deformation or brushing over.

Those skilled in the art will readily recognise that what has been described above as being the upper end of the prop could also be used as the lower end. For instance, in the case of the prop 55 of FIG. 6, the saw-cuts could be made in the lower end of the prop that bears on the footwall.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

We claim:

1. A yieldable load support comprising a compressible support member in the form of an elongated timber pole, the pole having respective ends and a central load axis, timber being removed, asymmetrically with respect to the central load axis of the pole, from at least one end of the pole so as to provide at least one pole end which is asymmetrically shaped with respect to the central load axis, the asymmetrical shape of the pole end positively inducing brushing of the at least one pole end in a predetermined sideways direction transverse to the central axis of the pole, when the support member is placed under longitudinal compressive loading of a predetermined magnitude.

2. The yieldable load support according to claim 1, wherein timber removed from the pole includes at least one slot cut in the timber pole asymmetrically with respect to the central load axis at the at least one end of the pole.

3. The yieldable load support according to claim 2, wherein the at least one slot is inclined at an acute angle with respect to the central load axis of the timber pole.

4. The yieldable load support according to claim 3, wherein a plurality of slots of varying depth are provided, each slot being inclined at an acute angle to the central load axis of the timber pole.

5. The yieldable load support according to claim 2, wherein a plurality of slots are provided, the plurality of slots are cut into the timber pole at the pole end, the slots being of varying depth and being normal to the central load axis of the timber pole.

6. The yieldable load support according to claim 1, wherein at least one cut is made in the pole end at an acute angle to the central load axis of the timber pole to provide the pole end with an angled face that is inclined at an acute angle to the central load axis of the pole and is asymmetrical with respect to the central load axis of the pole.

7. The yieldable load support according to claim 6, wherein at least two angled cuts are made in the pole end to provide the pole end with a plurality of angled faces each being inclined at an acute angle to the central load axis of the pole and being asymmetrical with respect to the central load axis of the pole.

8. The yieldable load support according to claim 7, wherein the angled cuts are made to leave a residual flat surface at the pole end and the residual flat surface being normal to the central load axis of the pole.

9. The yieldable load support according to claim 8, wherein the residual flat surface is off-set from the central load axis of the timber pole.

10. The yieldable load support according to claim 8, wherein the residual flat surface is on the central load axis of the timber pole.

11. The yieldable load support according to claim 6, wherein a single angled cut is made in the pole end to provide the pole end with an angled face that is inclined at an acute angle to the central load axis of the pole and is asymmetrical with respect to the central load axis of the pole, and a slot is cut in the pole end at a position off-set from the central load axis of the pole.

12. The yieldable load support according to claim 11, wherein the slot in the pole end is wedge-shaped.

13. The yieldable load support according to claim 1, wherein timber is removed from the pole end to provide the pole end with a conical shape which is asymmetrical with respect to the central load axis of the pole.

14. The yieldable load support according to claim 13, wherein timber is removed from the pole end leaving a residual flat surface at an apex of the conical shape, the residual flat surface being off-set from the central load axis of the pole.

15. The yieldable load support according to claim 14, wherein timber is removed from the pole end in such a manner that the pole includes a transverse shoulder around the base of the conical shape.

16. The yieldable load support according to claim 1, wherein the pole end is encircled by strengthening means applied to the timber pole at the pole end.

17. A method of making a yieldable mine prop, the method comprising the steps of providing an elongated timber pole having respective ends and a central load axis, removing timber asymmetrically with respect to the central load axis of the pole, from at least one end of the pole thereby providing a pole end which is asymmetrically shaped with respect to the central load axis, the asymmetrical shape of the pole end positively inducing brushing of the pole end in a predetermined sideways direction transverse to the central load axis of the pole, when the pole is placed under longitudinal compressive loading of a predetermined magnitude.

18. A method of supporting a mine hanging wall above a mine footwall, the method comprising the steps of installing, between the hanging wall and the footwall, a yieldable load support which includes a compressible support member being an elongated timber pole having respective ends and a central load axis, at least one end of the timber pole being shaped asymmetrically with respect to the central load axis of the pole and the installation of the yieldable load support being such that the central load axis of the timber pole is transverse to the hanging wall and the footwall, and allowing the pole end to brush over in a predetermined sideways direction transverse to the central load axis of the timber pole, under compressive loading applied longitudinally to the timber pole by closure of the hanging wall towards the footwall.

19. A yieldable load support comprising a compressible elongated timber pole having two opposed ends and a central longitudinal axis and means for inducing sideways brushing of the timber pole when a compressive load is applied to at least one of the ends of the pole, the means for inducing comprising at least one cut in the pole, the at least one cut intersecting said central longitudinal axis and being asymmetrical with respect to said central longitudinal axis of the pole.

20. The yieldable load support according to claim 19, wherein one end of the pole has the at least one cut therein and wherein the one end of the pole is engaged by force applying means for supplying a compressive load to the pole, the end of the pole engaging the force applying means deforming when a predetermined compressive load is applied to the pole, deformation of the pole increasing as the force applying means increases the compressive load above the predetermined compressive load and a surface contact area between the end of the pole and the force applying means increasing as deformation of the pole increases.

21. The yieldable load support according to claim 19, wherein the at least one cut is provided in a side of the pole adjacent at least one end of the pole.

22. The yieldable load support according to claim 19, wherein the at least one cut comprises a cut made by removing timber from at least one end of the pole.

* * * * *